US005186142A

United States Patent [19]

Brunelli et al.

[11] Patent Number: 5,186,142

[45] Date of Patent: Feb. 16, 1993

[54] IDLING SYSTEM FOR A DEVICE HAVING A SPEED GOVERNOR

[75] Inventors: Brian Brunelli, Greendale; John A. Fiorenza, II, Slinger, both of Wis.

[73] Assignee: Briggs & Stratton Corporation, Milwaukee, Wis.

[21] Appl. No.: 873,590

[22] Filed: Apr. 21, 1992

Related U.S. Application Data

[63] Continuation of Ser. No. 723,755, Jul. 1, 1991, abandoned.

[51] Int. Cl.[5] ..... F02M 3/00

[52] U.S. Cl. ..... 123/339; 417/34

[58] Field of Search ..... 123/339, 340, 350; 417/34

[56] References Cited

U.S. PATENT DOCUMENTS

| | | | |
|---|---|---|---|
| 2,022,094 | 11/1935 | Shoemaker et al. | 123/65 |
| 2,499,263 | 2/1950 | Troy | 123/102 |
| 2,804,552 | 8/1957 | McFarland | 290/40 |
| 3,217,652 | 11/1965 | Owen | 417/34 |
| 3,242,741 | 3/1966 | Catterson | 73/522 |
| 3,786,869 | 1/1974 | McLaughlin | 417/34 |
| 4,139,332 | 2/1979 | Cantrall et al. | 417/34 |
| 4,368,704 | 1/1983 | Masaki | 123/339 |
| 4,370,960 | 2/1983 | Otsuka | 123/339 |
| 4,425,888 | 1/1984 | Engel et al. | 123/339 |
| 4,502,436 | 3/1985 | Bonfiglioli et al. | 123/339 |
| 4,510,903 | 4/1985 | Sakakiyama | 123/339 |
| 4,546,744 | 10/1985 | Bonfiglioli | 123/339 |
| 4,549,400 | 10/1985 | King | 60/394 |
| 4,836,164 | 6/1989 | Morozumi et al. | 123/339 |
| 4,944,267 | 7/1990 | Mann | 123/339 |
| 4,969,435 | 11/1990 | Morikawa et al. | 123/339 |
| 5,035,580 | 7/1991 | Simonetta | 417/34 |

OTHER PUBLICATIONS

Engine Control Devices Idling System for Air Compressors, Sold at Least as Early as Dec. 1, 1989.

United Electric Controls Company Catalog, pp. 4–5 Regarding Type H100 Pressure Switches, Published in 1990.

Delaval Turbine, Inc. Flow Switches, described in "Machine Design", Electrical & Electronics 1978 Reference Issue, p. 145, Pub. May 18, 1978.

Cat Pumps Idling System for Pressure Washers, Sold at Least as Early as Aug. 1989.

*Primary Examiner*—Raymond A. Nelli

*Attorney, Agent, or Firm*—Andrus, Sceales, Starke & Sawall

[57] ABSTRACT

The idling system reduces the speed of an engine having a speed governor that is used to power an air compressor, a pressure washer, or another load device which outputs pressurized gases or fluids. The idling system includes a pressure or flow switch which is activated in response to a sensed pressure or fluid flow respectively in the load device. When the switch is activated, an electromagnet is energized through a diode rectifier by the engine alternator or other power source. The energizing of the electromagnet creates a magnetic field that attracts a governor lever arm on the engine's mechanical speed governor. Since the lever arm is interconnected with the throttle plate of the engine carburetor, movement of the lever arm rotates the throttle plate to reduce the engine speed to an idle speed.

19 Claims, 2 Drawing Sheets

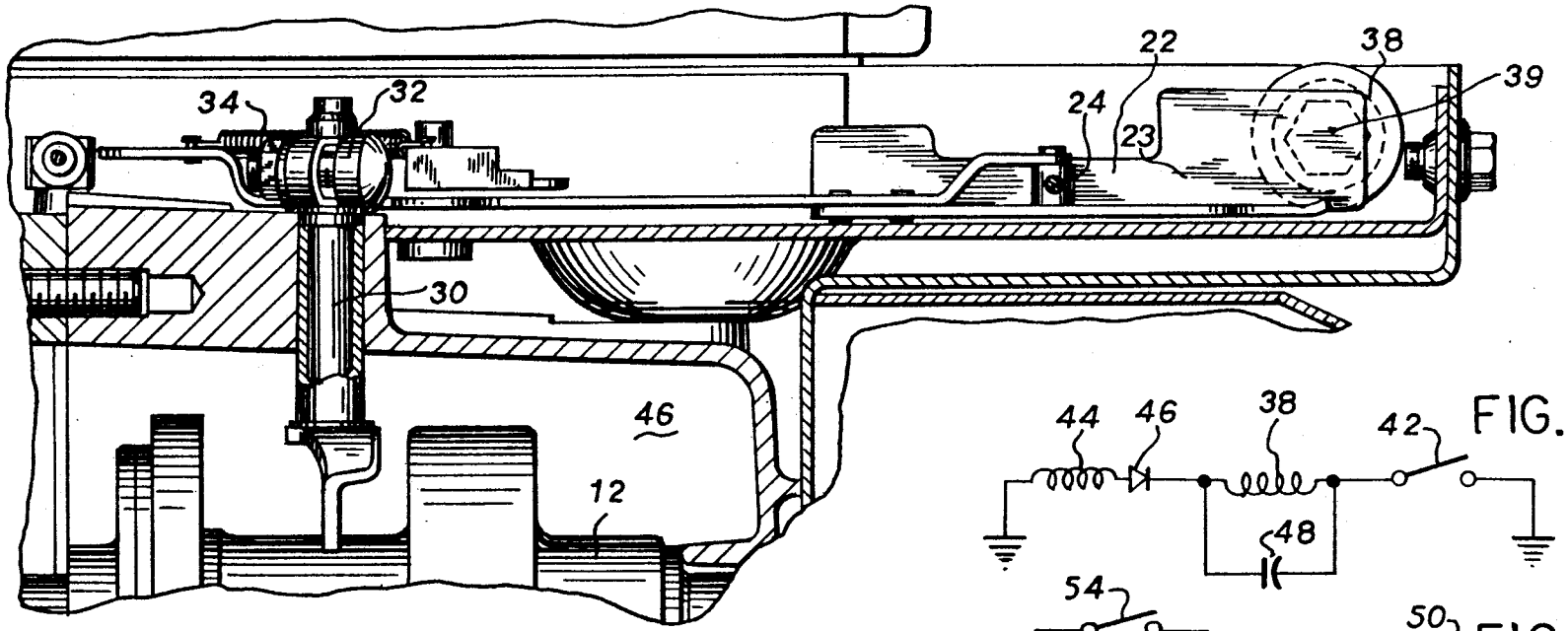
FIG. 2
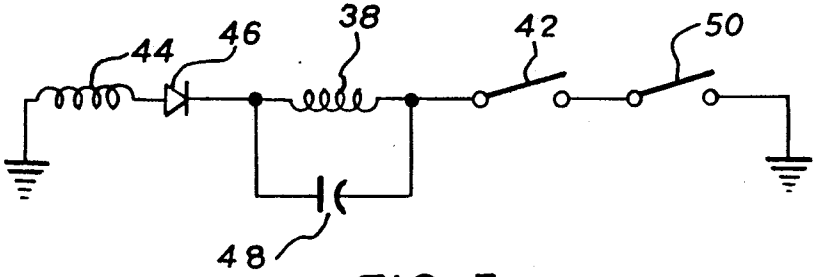
FIG. 3
FIG. 4
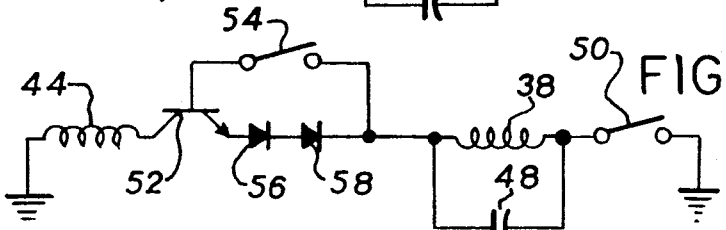
FIG. 5
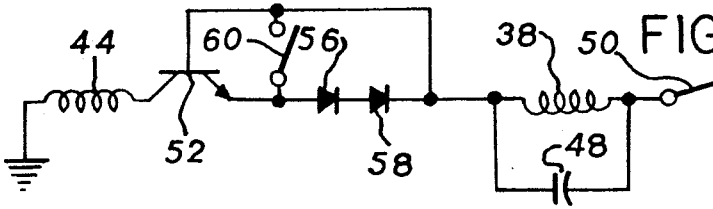
FIG. 6

IDLING SYSTEM FOR A DEVICE HAVING A SPEED GOVERNOR

This application is a continuation of Ser. No. 07/723,755, filed Jul. 1, 1991, now abandoned.

BACKGROUND OF THE INVENTION

This invention relates to devices which output a pressurized gas such as air compressors or which output a pressurized fluid such as pressure washers, airless paint sprayers and hydraulic power packs for powering hydraulic tools. More particularly, this invention relates to an idling system for an engine used to power such devices.

Many types of devices are known which output a pressurized gas or a pressurized fluid. For example, air compressors are used to operate many types of power equipment. Devices used to output pressurized fluids include pressure washers used to wash automobiles and other items, airless paint sprayers which output pressurized paint, and hydraulic power packs for powering hydraulic tools such as the mechanical jaws used to free victims of car accidents from their vehicles.

These devices which output pressurized gaseous or fluid materials are typically powered by an internal combustion engine that has a speed governor which controls the speed of the engine and thus the operation of the device. When the device—which is really a load on the engine—is being operated, it is desirable to have the engine work at a high operating speed for maximum power output. However, when the device is not operating, the engine powering a prior art device typically still operates at the higher operating speed, resulting in premature wear and failure of the engine, a shortened engine life, as well as excessive fuel consumption and noise from the engine.

SUMMARY OF THE INVENTION

An idling system is disclosed for an engine having a speed governor, wherein the engine powers a load device that outputs a gas or a fluid.

In its broadest concept, the idling system according to the present invention comprises a first switch means for activating in response to a pressure differential of a gas or a fluid, or in response to the flow of a gas or fluid in the load device. The sensing of a relatively high pressure differential indicates that the load device is not being operated at the moment, thereby activating the first switch means to activate the idling system. The sensing of a low flow rate of a gaseous or fluid material also indicates that the load is not being applied to the engine.

In either of these instances, the idling system according to the present invention causes the engine's speed to be reduced to an idle speed by magnetically acting on the engine's speed governor.

When the first switch means is activated, a current flows to an electromagnet means to energize the electromagnet means. The electromagnet means is positioned such that its magnetic field attracts an arm means, which is part of the speed governor. The movement of the arm means in turn effects the speed of the engine. In a preferred embodiment, the energizing of the electromagnet means moves the metal arm means toward it to reduce the engine's speed to an idle speed.

If the load device is thereafter operated, the first switch means is deactivated to de-energize the electromagnet means. The magnetic attraction on the arm means is reduced to permit the arm means to return to its normal position, thereby raising the engine's speed to operate the load device.

The electromagnet means is preferably an electromagnet or a solenoid powered by a current source that is part of the engine so that no external power source is needed. In a preferred embodiment, the engine alternator is used as the current source. The alternating signal from the alternator is rectified by one or more diodes and is smoothed by a filter capacitor. The resultant direct current signal energizes the electromagnet means when the first switch means is activated.

The first switch means may have one of several configurations. In a preferred embodiment, the first switch means consists of a pressure or flow switch in series with the electromagnet means. In alternate embodiments, the first switch means includes a semiconductor switch such as a transistor, and a second, pressure or flow switch interconnected with the base of the transistor such that the activation of the second switch turns on the semiconductor switch to allow the electromagnet means to energize.

It is a feature and advantage of the present invention to extend the life of an internal combustion engine used to power a load.

It is another feature and advantage of the present invention to reduce the fuel consumption and the noise level of an engine used to power a load device.

It is yet another feature and advantage of the present invention to provide an idling system which requires no external power supply and is powered by the engine alternator.

It is yet another feature and advantage of the present invention to provide an inexpensive idling system for load devices that output pressurized gases or fluids.

These and other features and advantages of the present invention will be apparent to those skilled in art from the following detailed description of preferred embodiments and the attached drawings, in which:

BRIEF DESCRIPTION OF THE DRAWINGS

FIG. 2 is a cross-sectional side view of the idling system according to the present invention, taken along line 2—2 of FIG. 1.

FIGS. 3-6 are schematic diagrams of alternate embodiments of the electromagnet and switch circuits according to the present invention, with FIGS. 3 and 4 being the preferred embodiments.

DETAILED DESCRIPTION OF PREFERRED EMBODIMENTS

Figure 1:
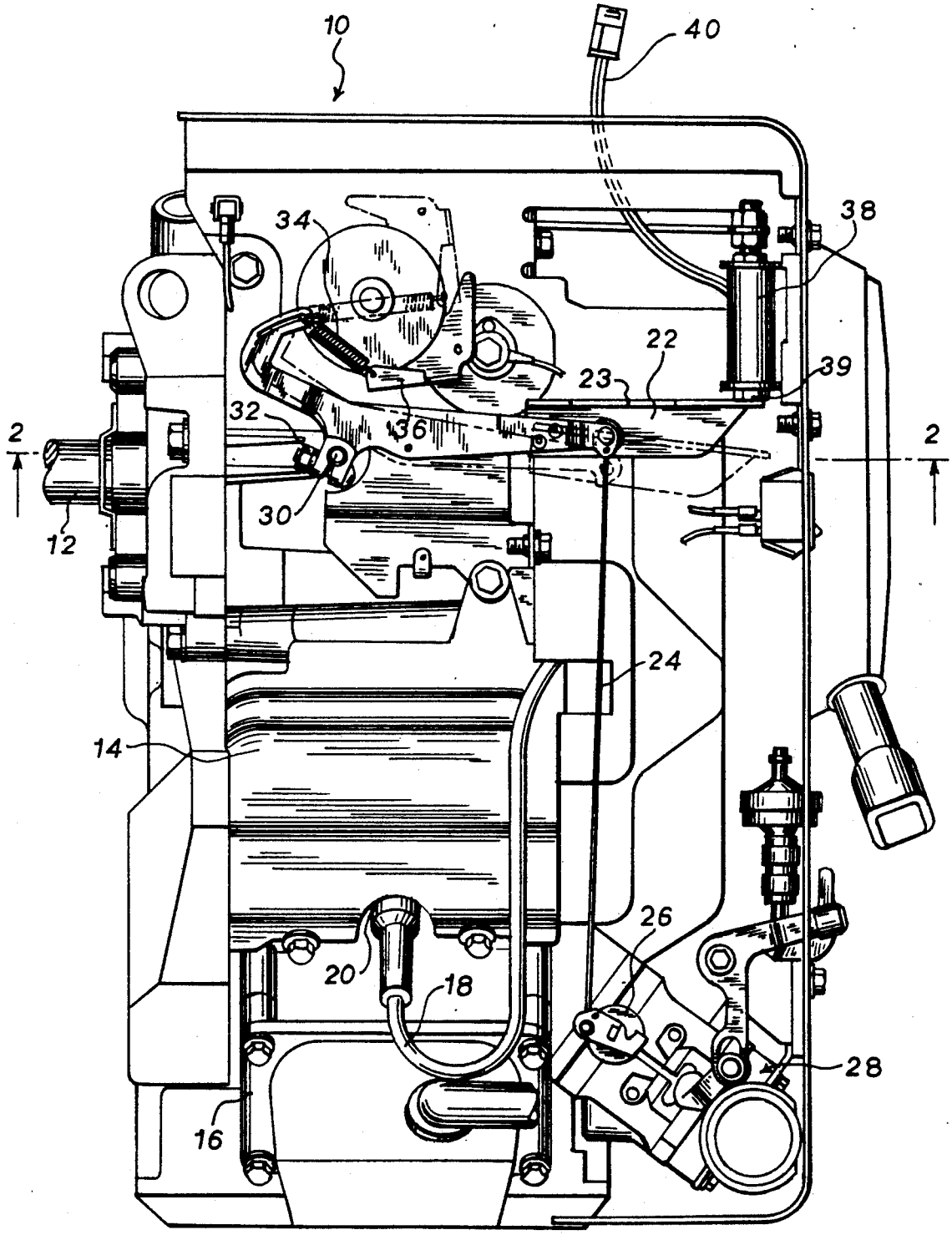
FIG. 1 is a top view of an engine incorporating the idling system according to the present invention.

FIG. 1 is a top view of an internal combustion engine incorporating the idling system according to the present invention. In FIG. 1, engine 10 has a horizontal crankshaft 12, a cylinder 14, a cylinder head cover 16 and a spark plug wire 18 that connects the ignition system (not shown) to a spark plug 20.

Engine 10 also has a conventional speed governor which maintains the engine's speed at a predetermined number of revolutions per minute when the load is applied. The speed governor is preferably a centrifugal governor like that disclosed in U.S. Pat. No. 3,242,741 issued Mar. 29, 1966 to Catterson and assigned to Briggs & Stratton Corporation, the assignee of the present invention. However, other centrifugal and non-centrifugal governors may be used as long as they have an arm means or metallic mechanical linkage whose movement effects the engine's speed.

In FIG. 1, the speed governor includes an arm means having a governor lever arm 22 and a governor link arm 24 which connects governor arm 22 to a throttle plate 26 of a carburetor 28. The arm means also includes a governor crank arm 30, a connector 32 consisting of a nut and bolt for connecting governor arm 22 to governor crank arm 30, and a spring 34 which connects governor arm 22 to a plate 36 that is attached to the engine housing.

The manner in which spring 34 is connected to arm 22 and to plate 36, as well as its spring rate, help determine at which predetermined speed the governor is set to operate. Spring 34 tends to oppose the forces resulting from the movement of the centrifugal flyweights (not shown), with the interaction between the opposed spring force and the centrifugal forces determining the governed speed.

Link arm 24 is depicted as being connected to a throttle plate or butterfly valve 26 of a carburetor 28. However, link arm 24 may be interconnected with another type of air/fuel mixing device other than a carburetor, such as a fuel injector system.

In FIG. 1, the idling system according to the present invention includes an electromagnet or a solenoid 38 which receives electrical energy via a lead 40. In turn, lead 40 is in electrical connection with a first switch means 42 and an alternator 44. See FIGS. 3 and 4. If an electromagnet is used for the electromagnet means, it preferably has 5000 turns of 34 gage wire wound on a core made from steel. One suitable core is a M8-1X75 type bolt sold by Rockford Products Corp., Rockford, IL. If a solenoid is used, one suitable solenoid for electromagnet means 38 is a D-4HD type solenoid, Part No. 56815-60 available from Deltrol Contols, Milwaukee, WI. A battery or another power source such as AC line current may be used in place of alternator 44.

The energizing of electromagnet 38 creates a magnetic field which tends to attract metallic governor lever arm 22. Electromagnet 38 is only energized when the first switch means is activated, indicating that no load device is being applied to the engine. If the first switch means includes a pressure switch, the first switch means is activated when a relatively high pressure is sensed in the device, indicating that the output valve is closed so that pressure is not being released.

If the first switch means includes a flow switch, the first switch means is activated when the flow switch determines that the flow of a gas or fluid within the device is either below a minimum level, indicating that the output valve is closed, or is above a predetermined level, indicating that the load is being applied and that the idling system should be shut off.

When electromagnet 38 is activated, electromagnet 38 attracts governor level paddle 23 on arm 22, causing lever arm 22 to move toward electromagnet 38 and opposing the spring force due to spring 34. The movement of lever arm 22 towards electromagnet 38 moves link arm 24 in a direction generally toward electromagnet 38, causing butterfly valve 26 to rotate to partially or totally close the butterfly valve. The partial or total closing of butterfly valve 26 tends to reduce the engine's speed to a predetermined, lower idle speed.

When a load is applied to the engine, the idling system is deactivated and electromagnet 38 is de-energized. The de-energizing of electromagnet 38 reduces the magnetic attraction on lever arm 22, allowing the lever arm to move to its predetermined position as determined by the spring rate of spring 34 and the movement of the centrifugal flyweights as discussed above. The movement of lever arm 22 away from electromagnet 38 causes link arm 24 to also move in a direction away from electromagnet 38, thereby opening butterfly valve 26 and increasing the engine's speed to the governed operating speed.

FIG. 2 is a side cross-sectional view of the idling system and engine assembly depicted in FIG. 1, taken along line 2—2 of FIG. 1. In FIG. 2 as in all the figures, corresponding components have been given the same numerical designations. FIG. 2 more clearly depicts the interconnection between lever arm 22 and governor crank arm 30 which extends into engine crankcase 46.

FIGS. 3 through 6 are schematic diagrams depicting alternate embodiments of the idling system according to the present invention. In FIG. 3, a source of alternating current such as an engine alternator 44 generates an alternating current signal that is rectified by diode rectifier 46. The rectified current energizes electromagnet 38, whose output is smoothed by a filter capacitor 48 connected across electromagnet 38. A pressure or flow switch 42 is closed when the switch senses that the load device is not being operated. A feature switch 50 may be a manual switch that is opened by the operator to shut off the idling system when desired, as during engine starting.

The circuit in FIG. 4 is similar to the circuit in FIG. 3 except that the feature switch has been eliminated to reduce cost.

FIGS. 5 and 6 depict alternate embodiments in which a pressure or flow switch is used to control the turning on of a semiconductor switch such as transistor 52.

In FIG. 5, the closing of switch 54 connected to the base of transistor 52 turns on transistor 52 to enable an alternating signal from alternator 44 to be rectified by diodes 56 and 58 and to energize electromagnet 38 if feature switch 50 is also closed.

In FIG. 6, the opening of switch 60 causes a voltage potential to be present at the gate of transistor 52, thereby turning on transistor 52. When transistor 52 is turned on, electromagnet 38 is energized through diodes 56 and 58 as discussed above in connection with FIG. 5.

Normally open and normally closed pressure switches suitable for using with the present invention are available from United Electric Controls Co. of Watertown, Massachusetts, type H100. Suitable flow switches for use with the present invention are available from Delaval Turbine Inc. of Farmington, CT.

Although particular embodiments have been shown and described, other alternate embodiments will be apparent to those skilled in the art and are within the intended scope of the present invention. Therefore, the invention is to be limited only by the following claims.

We claim:

1. An idling system for an engine having a speed governor that sets the engine sped to a governed speed, said engine powering a load that outputs a gas or a fluid material, said speed governor including arm means whose movement effects the engine speed, the idling system comprising:

a current source;

electromagnet means for magnetically attracting said arm means to change said engine speed, wherein the electromagnet means is connected in circuit to said current source without any significant intermediate inductive component;

switch means for activating in response to a pressure differential or a flow of said material in said load and for switching current from said current source to said electromagnet means; and means for electrically connecting said electromagnet means to said switch means.

2. The idling system of claim 1, wherein said switch means is connected between said current source an said electromagnet means.

3. The idling system of claim 2, wherein said switch means includes:

a semiconductor switch; and a pressure or flow switch interconnected with said semiconductor switch that controls said semiconductor switch.

4. The idling system of claim 1, wherein said electromagnet means is directly connected to said current source without any intermediate switch.

5. The idling system of claim 1, wherein there is no operative mechanical connection between said electromagnet means and said arm means.

6. The idling system of claim 1, wherein said current source includes:

an alternator; and a rectifier connected in series with said alternator.

7. The idling system of claim 1, wherein said current source includes a battery.

8. The idling system of claim 1, wherein said switch means includes a pressure switch.

9. The idling system of claim 1, wherein said switch means includes a flow switch.

10. The idling system of claim 1, further comprising:

a second switch means for turning off the idling system.

11. The idling system of claim 1, wherein said load is a pressure washer.

12. The idling system of claim 1, wherein said load is an air compressor.

13. An idling system for an engine having a speed governor that sets the engine speed to a governed speed, said engine powering a load that outputs a gas or a fluid material, said speed governor including arm means whose movement effects the engine speed, the idling system comprising:

a current source;

electromagnet means for magnetically attracting said arm means to change said engine speed, wherein there is no operative mechanical connection between said electromagnet means and said arm means;

switch means for activating in response to a pressure differential or a flow of said material in said load and for switching current from said current source to said electromagnetic means; and means for electrically connecting said electromagnet means to said switch means.

14. The idling system of claim 13, wherein said switch means includes:

a semiconductor switch; and a pressure or flow switch interconnected with said semiconductor switch that controls said semiconductor switch.

15. The idling system of claim 13, wherein said current source further comprises:

an alternator; and a rectifier connected in series with said alternator.

16. The idling system of claim 13, wherein said switch means includes a pressure switch.

17. The idling system of claim 13, wherein said load means includes a flow switch.

18. The idling system of claim 13, wherein said load is a pressure washer.

19. The idling system of claim 13, wherein said load is an air compressor.

* * * * *

UNITED STATES PATENT AND TRADEMARK OFFICE

CERTIFICATE OF CORRECTION

PATENT NO. : 5,186,142

DATED : February 16, 1993

INVENTOR(S) : Brunelli et al

It is certified that error appears in the above-identified patent and that said Letters Patent is hereby corrected as shown below:

CLAIM 1, Col. 4, Line 60, delete "sped" and substitute therefor ---speed---; CLAIM 2, Col. 5, Line 10, delete "an" and substitute therefor ---and---; CLAIM 17, Col. 6, Line 33, delete "load" and substitute therefor ---switch---;

Signed and Sealed this

Fourth Day of January, 1994

*Attest:*

Bruce Lehman

BRUCE LEHMAN

*Attesting Officer*

*Commissioner of Patents and Trademarks*